US009624925B2

(12) United States Patent
Christov et al.

(10) Patent No.: US 9,624,925 B2
(45) Date of Patent: Apr. 18, 2017

(54) TWO-SPINDLE PUMP OF SINGLE-FLOW CONSTRUCTION

(71) Applicant: Jung & Co. Geratebau GmbH, Kummerfeld (DE)

(72) Inventors: Weshen Christov, Buckeburg (DE); Hans Jung, Pinneberg (DE)

(73) Assignee: Jung and Co. Geratebau, GMBH, Kummerfeld (DE)

( * ) Notice: Subject to any disclaimer, the term of this patent is extended or adjusted under 35 U.S.C. 154(b) by 0 days.

(21) Appl. No.: 13/754,650

(22) Filed: Jan. 30, 2013

(65) Prior Publication Data

US 2013/0251581 A1 Sep. 26, 2013

(30) Foreign Application Priority Data

Jan. 31, 2012 (DE) ..... 10 2012 001 700

(51) Int. Cl.

| | |
|---|---|
| ***F04C 2/00*** | (2006.01) |
| ***F04C 2/16*** | (2006.01) |
| ***F04C 15/00*** | (2006.01) |
| ***F01C 17/02*** | (2006.01) |
| ***F01C 21/10*** | (2006.01) |

(52) U.S. Cl.

CPC ..... *F04C 2/00* (2013.01); *F01C 17/02* (2013.01); *F01C 21/10* (2013.01); *F04C 2/16* (2013.01); *F04C 15/0061* (2013.01); *F04C 2230/601* (2013.01); *F04C 2230/80* (2013.01); *F04C 2240/60* (2013.01); *F04C 2270/16* (2013.01); *F04C 2270/17* (2013.01)

(58) Field of Classification Search

CPC .... F01C 21/10; F01C 21/102; F04C 2230/80; F04C 2/16–2/20; F04C 18/16–18/20

USPC ... 418/191, 201.1, 201.3, 206.5, 206.7, 220; 74/395

See application file for complete search history.

(56) References Cited

U.S. PATENT DOCUMENTS

| | | | | |
|---|---|---|---|---|
| 1,805,875 A * | 5/1931 | Levin | ..... | 418/15 |
| 2,287,716 A * | 6/1942 | Whitfield | ..... | 418/201.1 |
| 2,641,937 A | 6/1953 | Erhardt | | |

(Continued)

FOREIGN PATENT DOCUMENTS

| | | |
|---|---|---|
| DE | 2001000 A | 7/1971 |
| DE | 2637221 A1 | 4/1977 |

(Continued)

*Primary Examiner* — Thomas Denion
*Assistant Examiner* — Laert Dounis
(74) *Attorney, Agent, or Firm* — Mark Rodgers

(57) ABSTRACT

The invention relates to a two-spindle screw pump of single-flow construction, comprising a pump housing, which has a pump portion, a bearing portion and a gear portion with a gear chamber, wherein the bearing portion and the pump portion are realized separately from each other characterized in that the gearwheel and the fastening element (and thus the shaft) are mutually rotatable, so that a spacing of the flanks of the feed screws (the flank clearance of the feed screws) is adjustable, that an opening is provided on the gear portion of the pump housing, that the opening is provided with a detachable cover, that the opening is arranged such that the cover is detachable in the mounted state of the screw pump, and that the gear chamber, for the adjustment of the flank clearance of the feed screws, can be reached with the tool necessary for this purpose.

8 Claims, 10 Drawing Sheets

(56) References Cited

U.S. PATENT DOCUMENTS

Figure 1A:
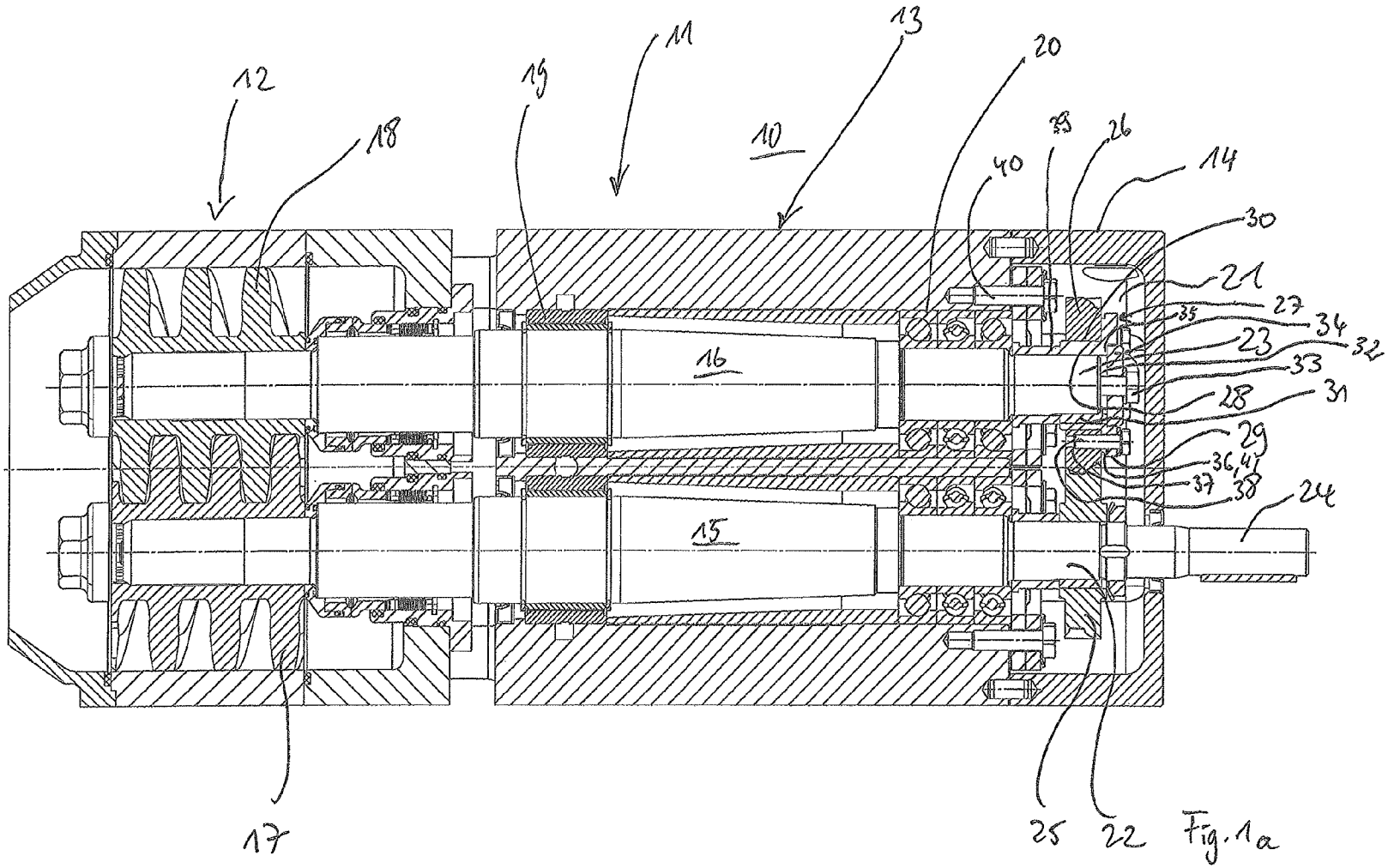

| | | | | | |
|---|---|---|---|---|---|
| 2,683,994 | A * | 7/1954 | Whitfield | 74/395 | |
| 3,037,396 | A | 6/1962 | Martin | | |
| 3,057,665 | A * | 10/1962 | Zalis | 406/100 | |
| 4,078,653 | A * | 3/1978 | Suter | 198/625 | |
| 6,027,322 | A * | 2/2000 | Ferentinos et al. | 418/1 | |
| 6,129,533 | A * | 10/2000 | Brandt et al. | 418/104 | |
| 2008/0240967 | A1 * | 10/2008 | Goepfert | F04C 18/084 | 418/191 |

FOREIGN PATENT DOCUMENTS

| | | | | |
|---|---|---|---|---|
| DE | 202009014604 U1 | 3/2010 | | |
| GB | 2432631 A * | 5/2007 | | F04C 2/18 |
| WO | WO 2004053333 A1 * | 6/2004 | | F04C 2/16 |

* cited by examiner

TWO-SPINDLE PUMP OF SINGLE-FLOW CONSTRUCTION

The invention relates to a two-spindle screw pump of single-flow construction, comprising a pump housing, which has a pump portion, a bearing portion and a gear portion with a gear chamber, wherein the bearing portion and the pump portion are realized separately from each other, comprising a feed housing part as a component part of the pump portion, in which two shaft-mounted feed screws with flanks are provided, wherein the shafts are mounted in the bearing portion (external bearing) and extend into the gear portion, comprising gearwheels, which are arranged on the shafts in the gear portion and by means of which the shafts are rotatably coupled, and comprising a fastening element, arranged on the shaft in operative connection therewith, for establishing a holding connection between shaft and gearwheel, wherein the fastening element and the gearwheel have corresponding bores, via which, between the gearwheel and the fastening element, a holding connection can be established via a locking element.

The feed screws arranged on the shafts are fastened with a defined clearance between the flanks (flank clearance).

A pump construction of this kind is known from DE 2009014604 U1. These pumps are distinguished, in particular, by an operation that is easy on the product and accompanying low wear and tear.

There is a need for improvement such that the complexity associated with the maintenance of the pumps shall be reduced. This occurs in particular when the feed screws or the face seals have to be exchanged for reasons of wear and the flank clearance has to be readjusted. For this, it is currently necessary that the gear portion and bearing portion of the pump must also be disconnected from the drive so as then to be able to perform an appropriate adjustment of the flank clearance of the feed screws.

The object of the invention is to improve the aforesaid pump such that a simpler and less time-consuming maintenance or readjustment can be performed.

The object is achieved by virtue of the fact that an opening is provided on the gear portion of the pump housing, that the opening is provided with a detachable cover, that the opening is arranged such that the cover is detachable in the mounted state of the screw pump, and that the gear chamber, for the adjustment of the flank clearance of the feed screws, can be reached with the tools necessary for this purpose.

As a result of the provision of the opening in the housing, it is possible to considerably reduce the time spent in readjusting the spindle, since it is no longer necessary to disassemble the gear housing to expose the gear chamber, nor is it necessary to disassemble the drive module.

A further teaching of the invention provides that the bores in the fastening element are realized such that the gearwheel and the fastening element (and thus the shaft) are mutually rotatable, so that a spacing of the flanks of the feed screws (the flank clearance of the feed screws) is adjustable, so that the bores in the fastening element are here provided as a circumferential elongated hole, in which the locking element, in the inserted yet unlocked state, is circumferentially displaceable, and so that the circumferential length of the elongated hole is here provided such that its end points conform at least to the points of contact of the flanks of the feed screws.

The maintenance and adjustability of the screw pump are herein improved in that it is possible to adjust the total flank clearance of the feed screws by the provision of the elongated hole. In this context, it has hitherto been necessary for the gearwheel, if need be, to be removed from the shaft and remounted in realigned arrangement so as to be able to appropriately adjust the flank clearance. This adjustment complexity is thereby considerably reduced.

A further teaching of the invention provides that the fastening element with the elongated holes is provided only on one shaft. This takes account of the factor that it has proved sufficient to adjust only one shaft, whilst the other shaft is constantly mounted.

A further teaching of the invention provides that the circumferential length of the elongated holes is longer than the circumferential spacing of the points of contact of the flanks of the feed screws. It is hereby possible to compensate for possible one-sided wear of the flanks by appropriate displacement beyond the original end points.

A further teaching of the invention provides that a hydraulic separation exists between the pump portion and the bearing portion, preferably via a face seal, and/or that a spatial separation exists between the bearing portion and the gear portion. In terms of the adjustability of the flank clearance and of the bearing, these spatial separations have proved particularly advantageous.

Furthermore, it is advantageous that the fastening element has a bushing portion for slipping onto the shaft, wherein the bushing portion preferably has a receiving portion for the gearwheel, and/or wherein the shaft and the bushing portion have a groove for the reception of a feather key for establishing a rotationally operative connection between the shaft and the fastening element. This embodiment constitutes a cost-effective and particularly maintenance-friendly embodiment of the invention.

A further advantageous embodiment of the invention is one in which the bores of the gearwheel are realized as drilled holes with threaded portion, and/or in which a locking element in the form of a bolt is insertable into the bores, by which bolt the holding connection can be established. In addition, it is advantageous that a bore is provided in the shaft head, into which bore can be introduced a locking element which locks the fastening element against the shaft, preferably with a clamping washer.

Figure 1B:
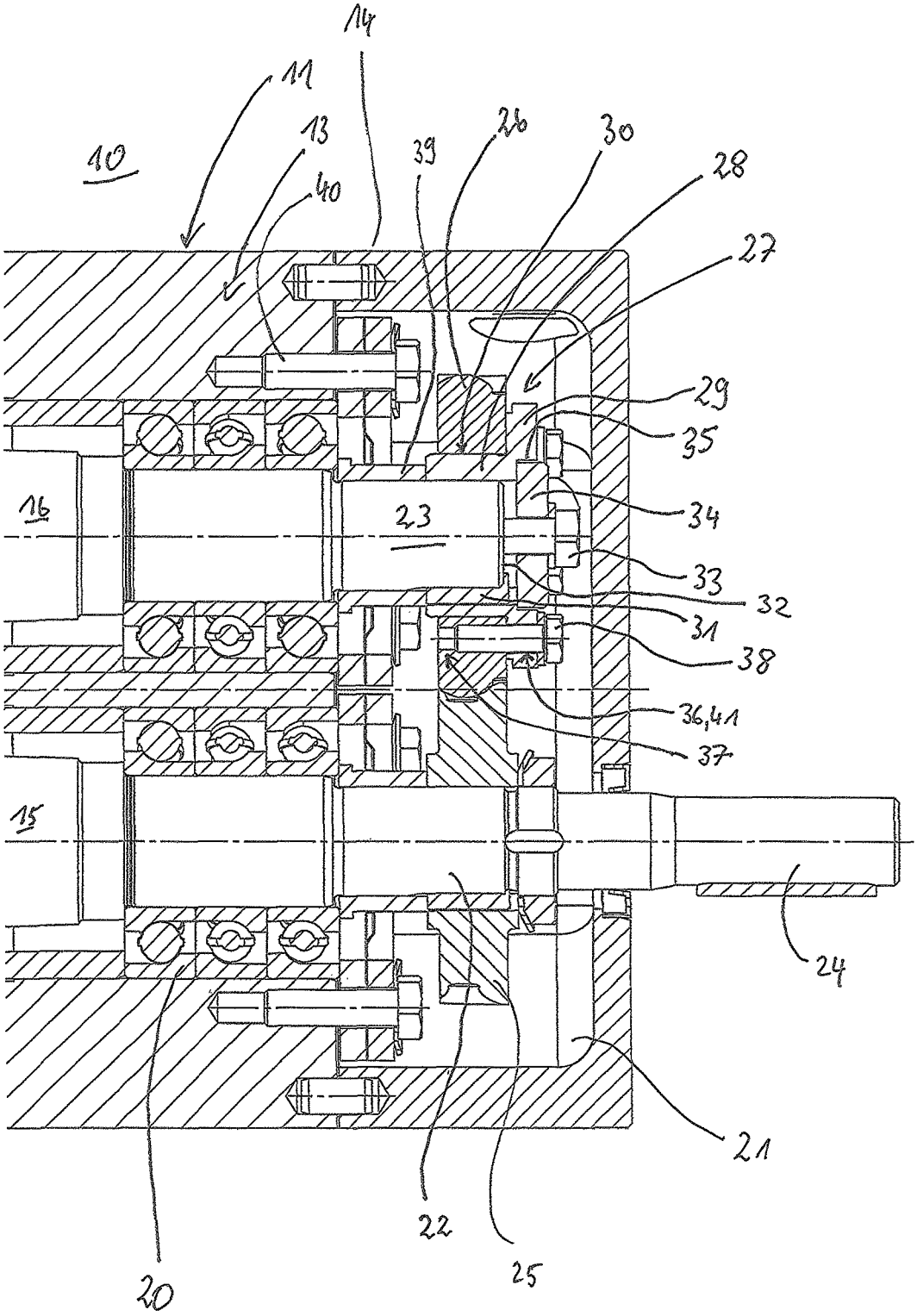
Figure 2:
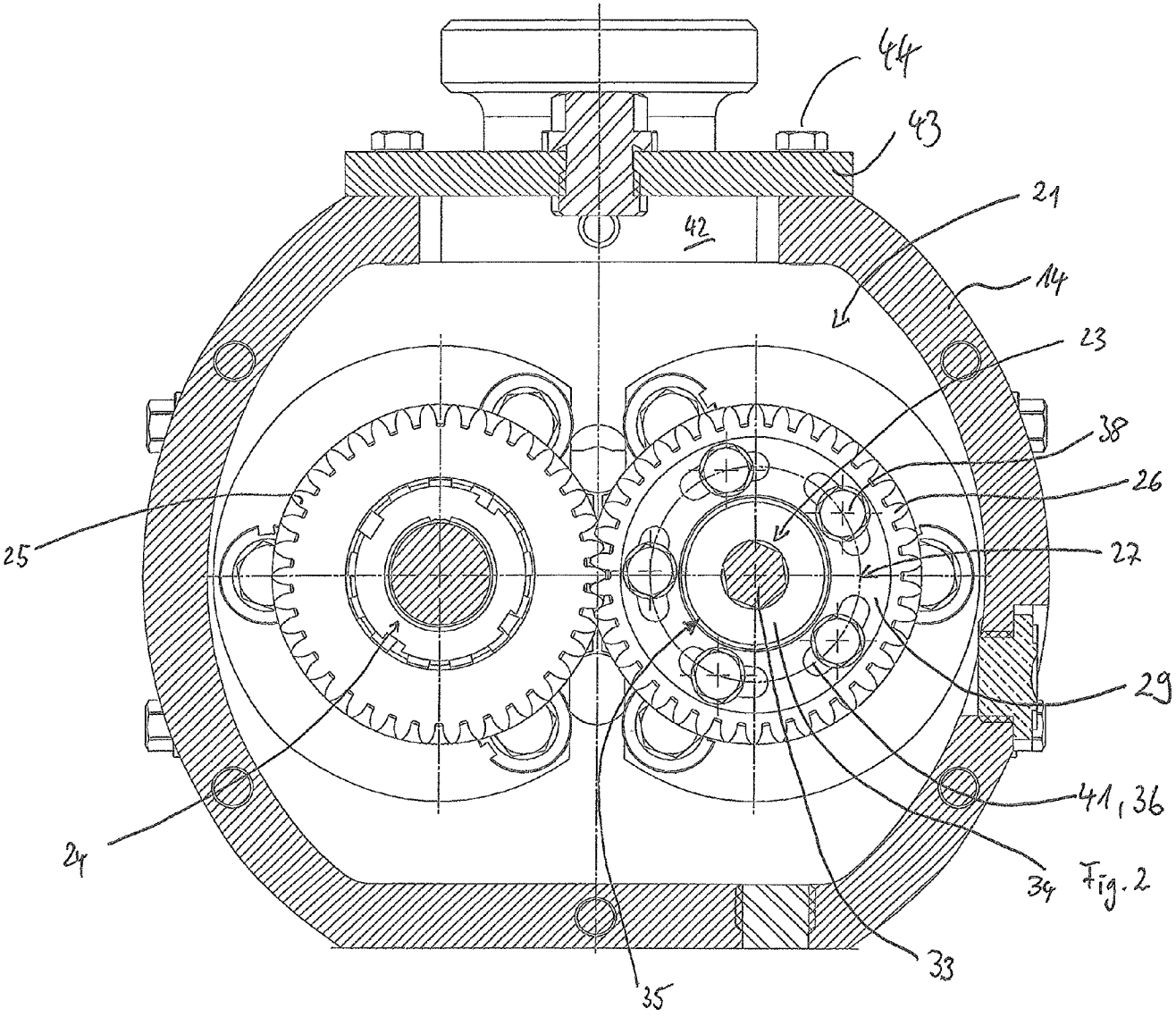
Figure 3:
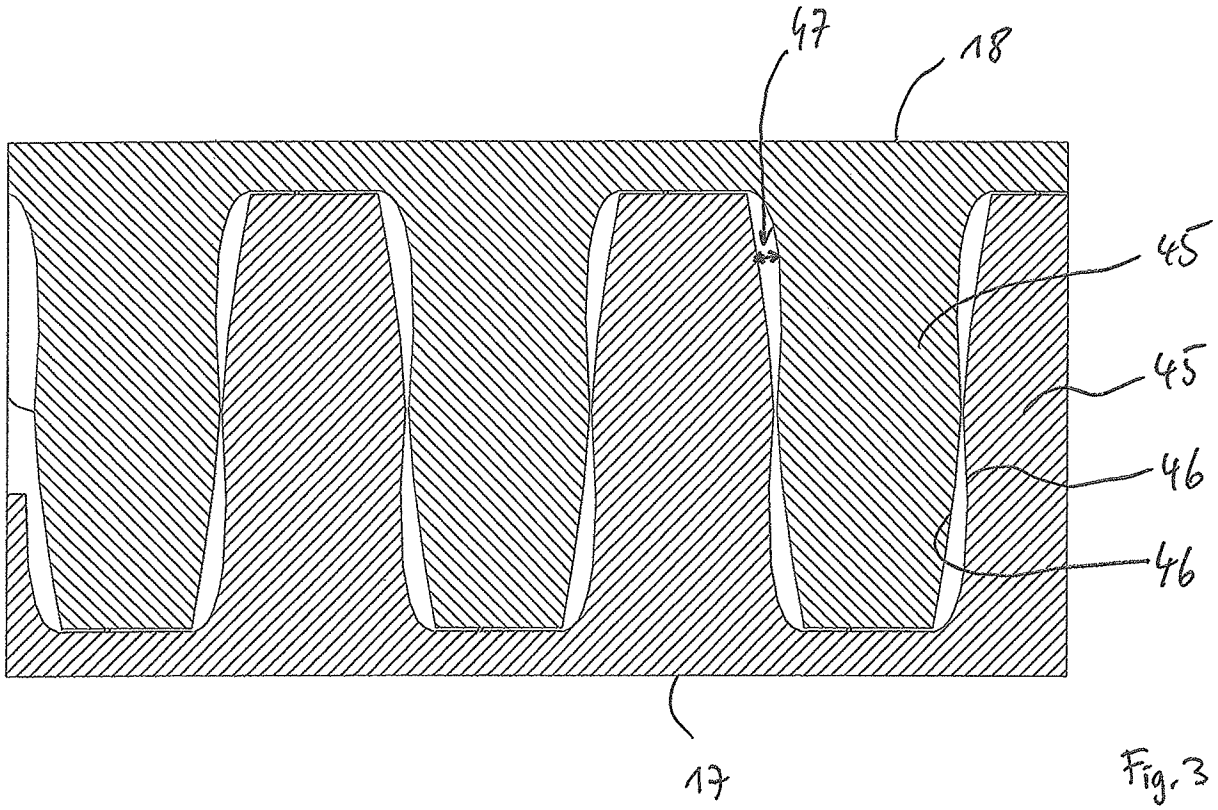
Figure 4:
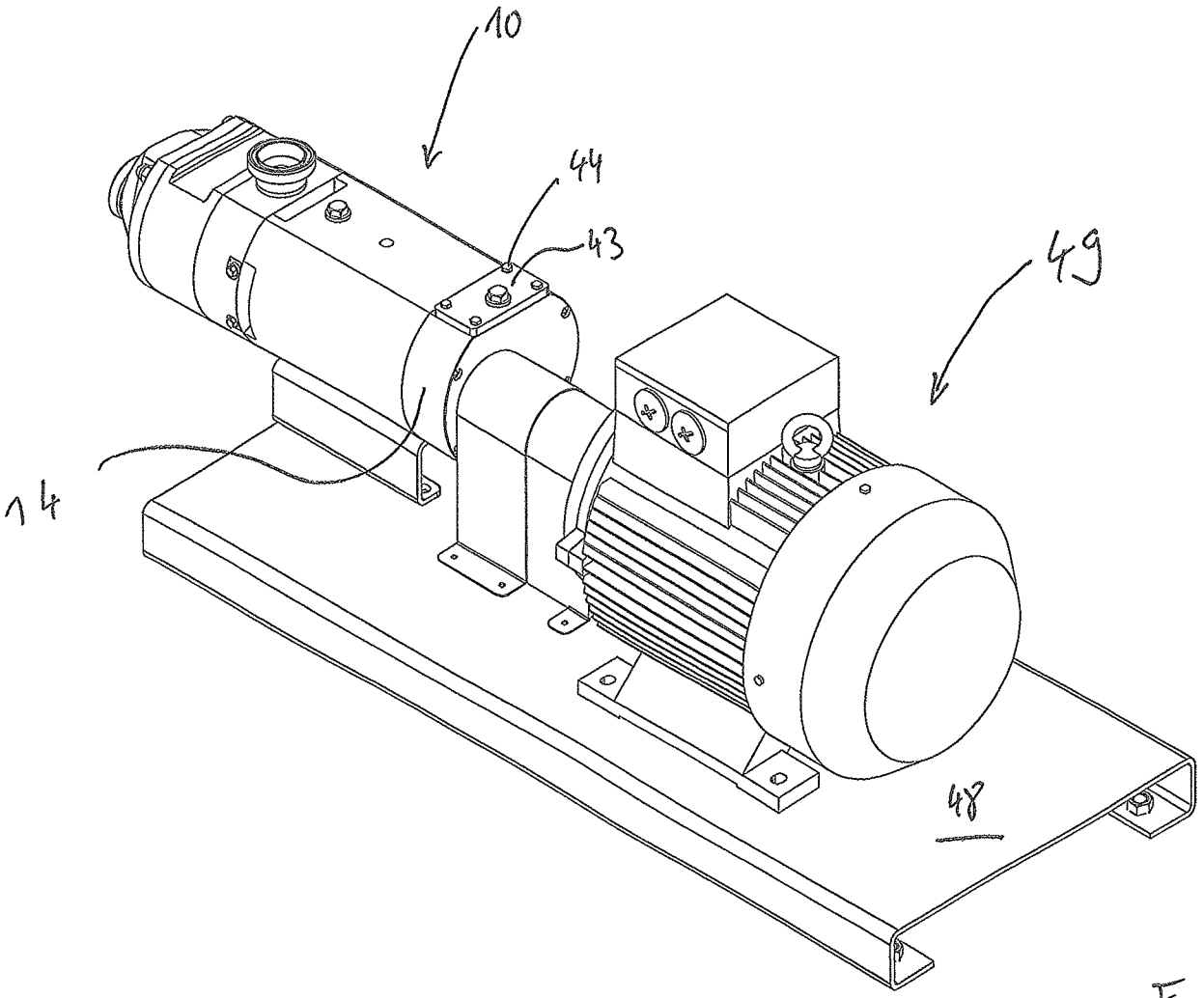
Figures 5, 6:
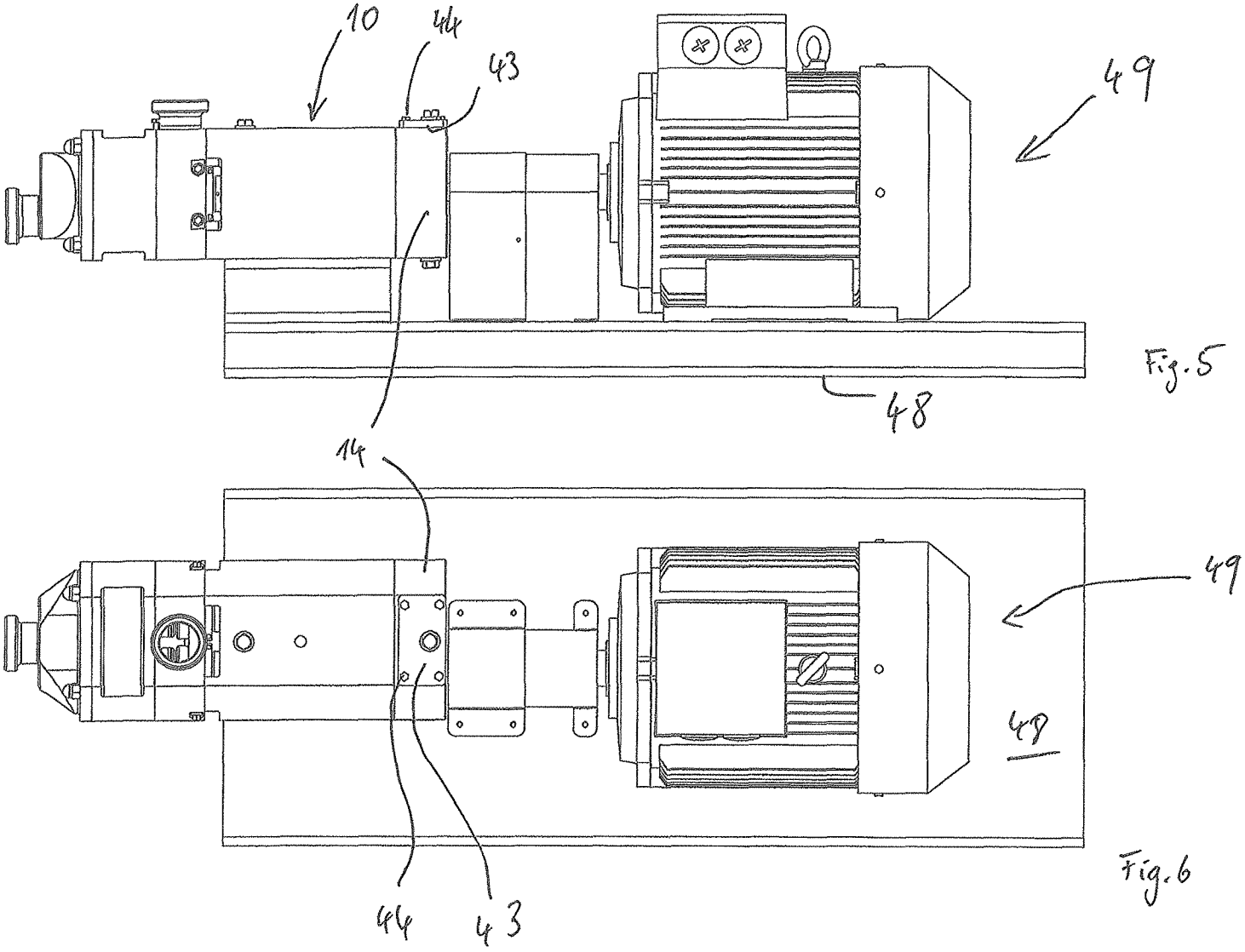
Figure 7:
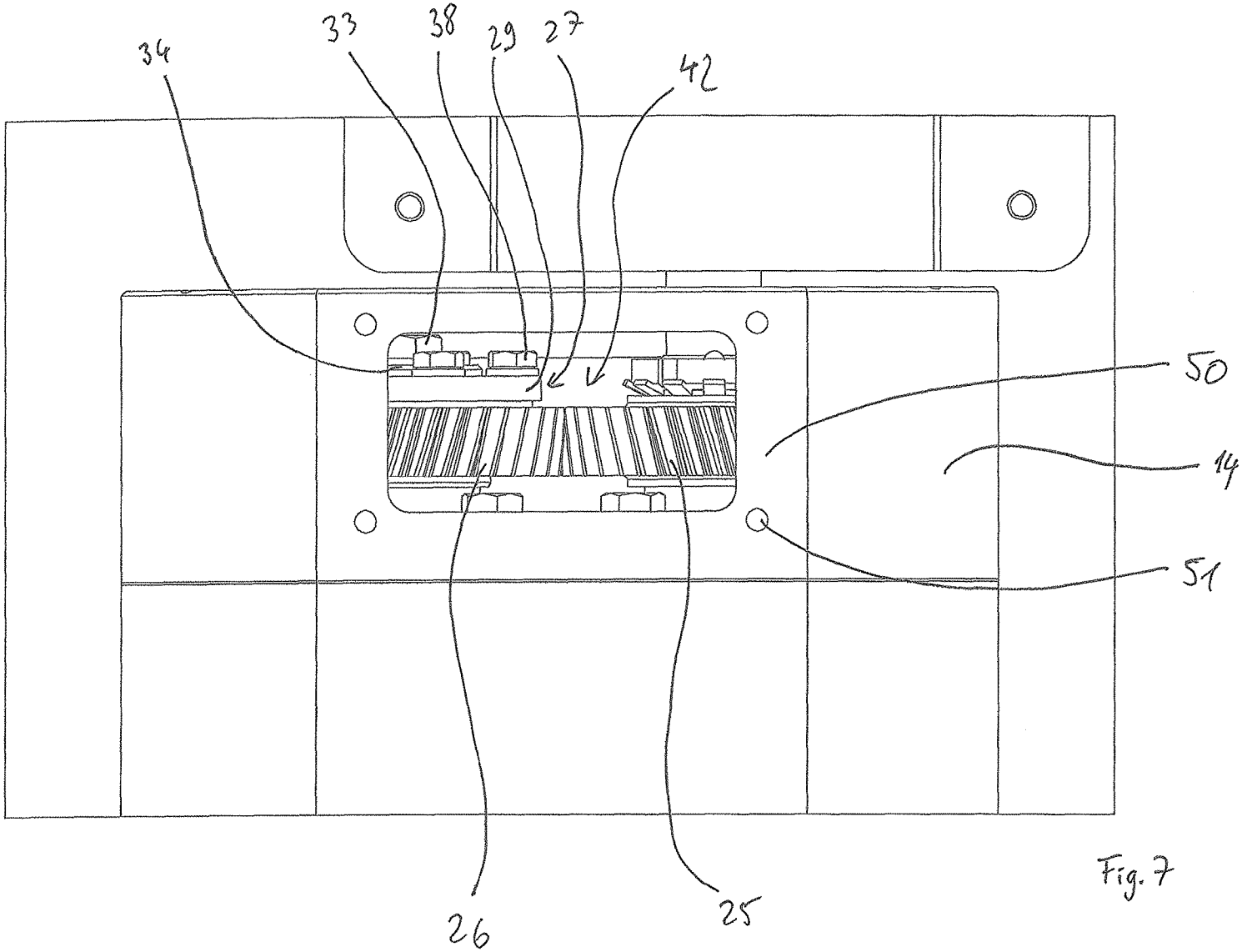
Figure 8:
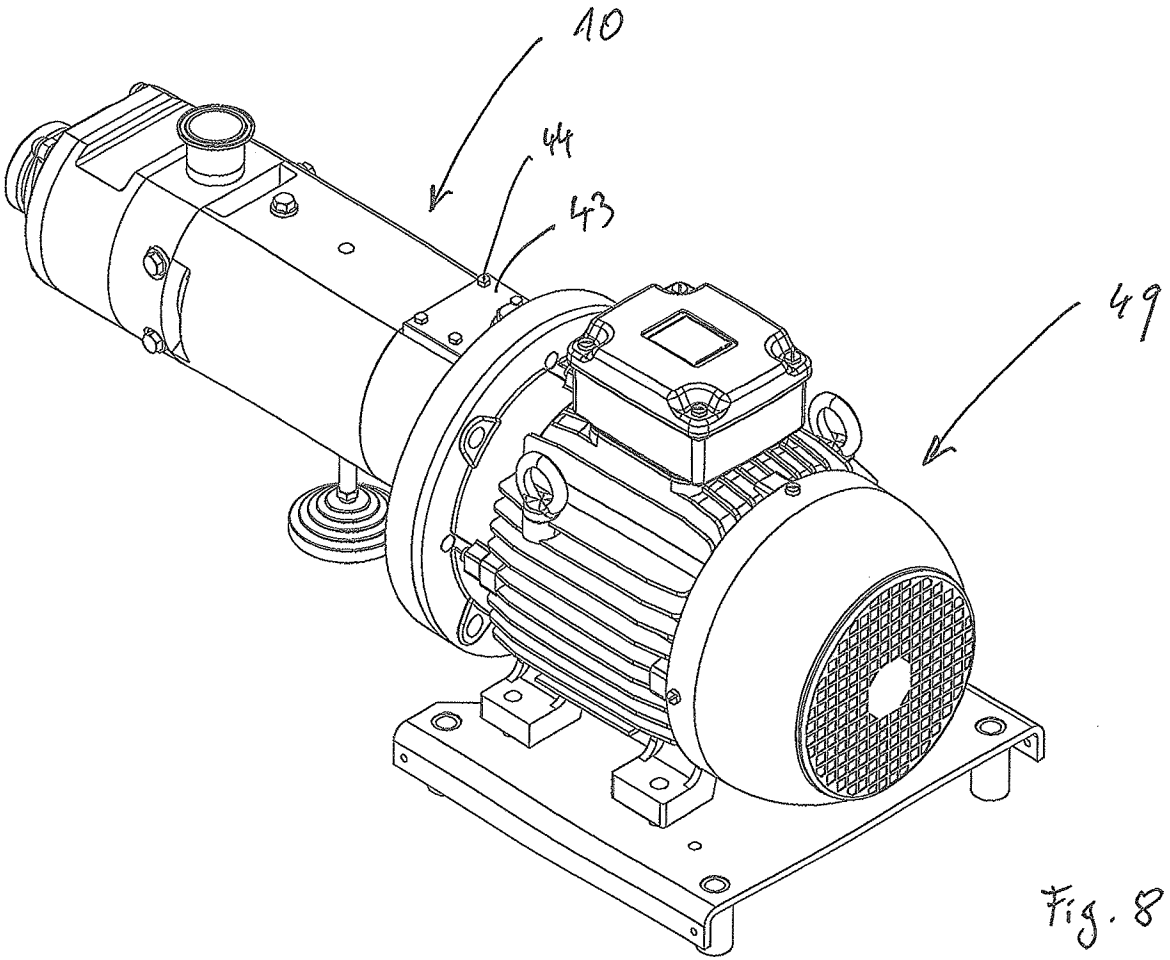
Figures 9, 10:
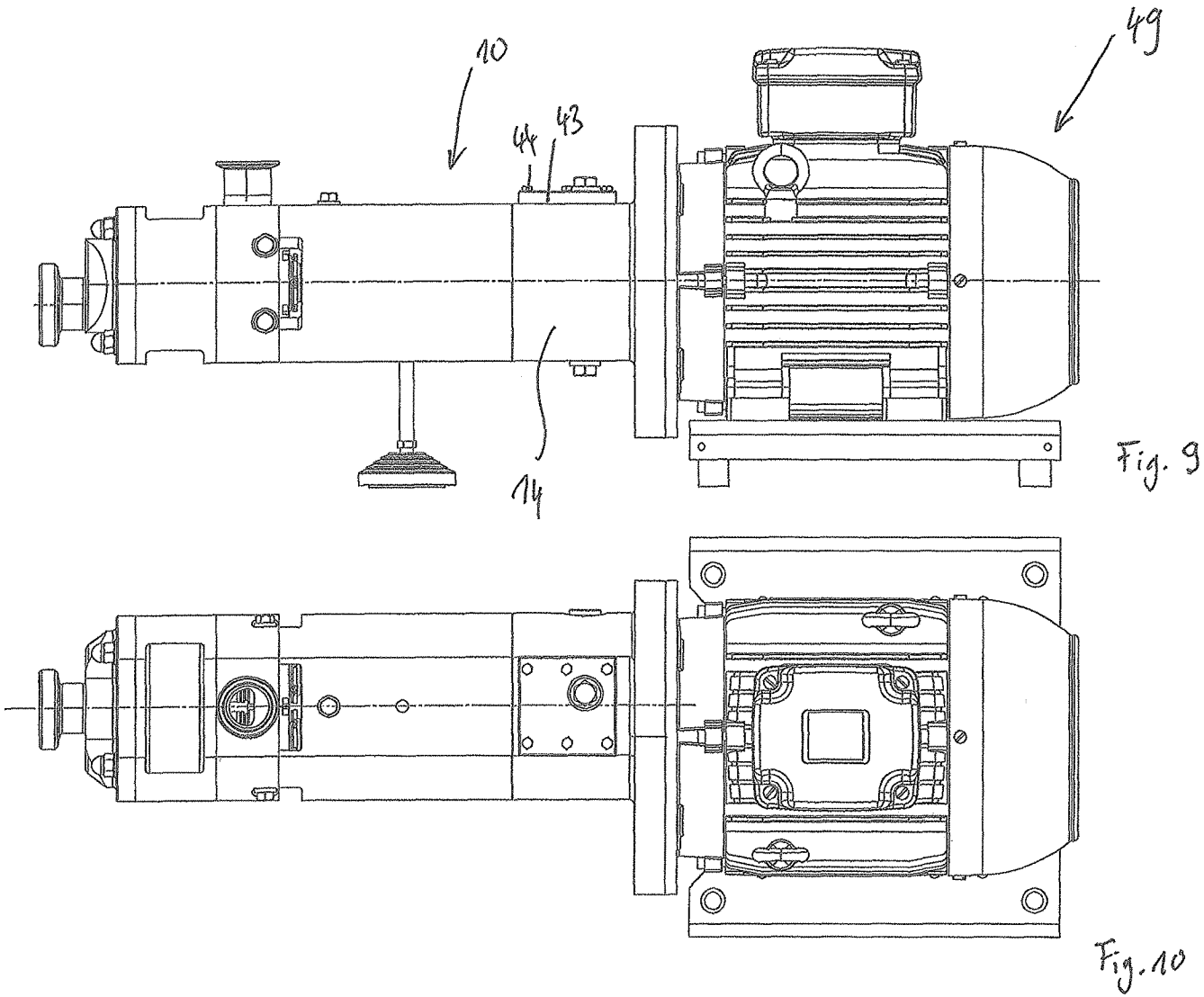
Figure 11:
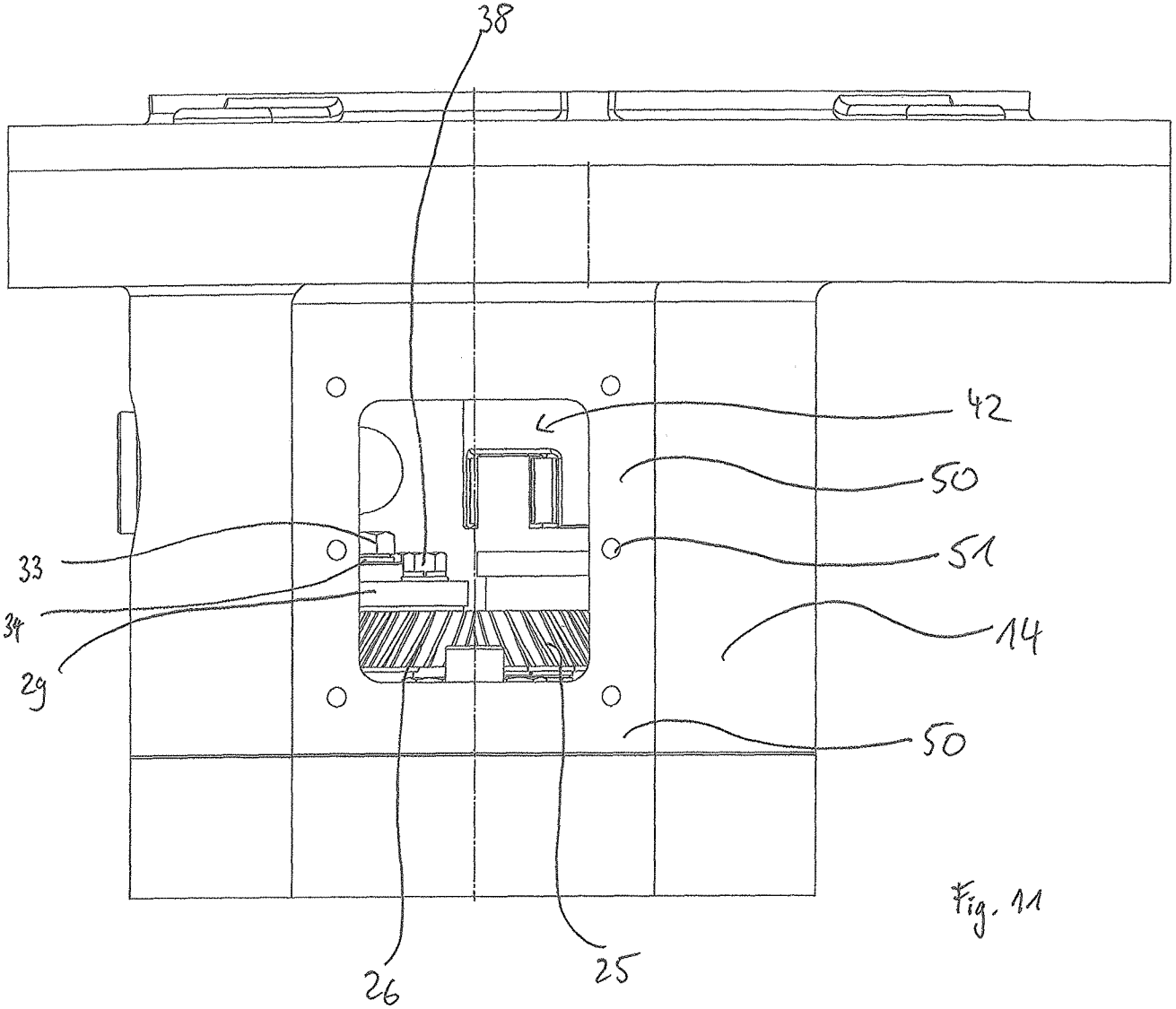

The invention is explained in greater detail below with reference to an illustrative embodiment in conjunction with a drawing, wherein:

FIG. 1*a* shows a sectional view through a top view of a pump according to the invention, FIG. 1*b* shows an enlarged detailed view in relation to FIG. 1*a*, FIG. 2 shows a sectional view of a pump according to the invention in sectional view through the gear portion, FIG. 3 shows a sectional view through the feed screws, FIG. 4 shows a three-dimensional view of a first embodiment of a pump according to the invention with drive, FIG. 5 shows a side view in relation to FIG. 4, FIG. 6 shows a top view in relation to FIG. 4, FIG. 7 shows a top view of the gear portion in relation to FIG. 1 in an embodiment in relation to FIG. 4, FIG. 8 shows a three-dimensional view of a second embodiment, FIG. 9 shows a side view in relation to FIG. 8, FIG. 10 shows a top view in relation to FIG. 8, and FIG. 11 shows a top view of the gear portion in relation to FIG. 1 in an embodiment in relation to FIG. 8.

FIG. 1*a* and FIG. 1*b* show a sectional view in a top view of a screw pump 10 according to the invention. The screw pump 10 has a housing 11, which has a pump portion 12, a bearing portion 13 and a gear portion 14. These are separated from one another spatially and hydraulically. The screw pump 10 further comprises a drive shaft 15 and a driven shaft 16. On the drive shaft 15 is disposed a feed screw 17 and on the driven shaft 16 is disposed a feed screw 18, which feed screws are in mutual engagement. In the bearing portion 13 are provided a needle bearing 19 and a roller bearing 20, so that the shafts are mounted in an external bearing outside the pump portion 12. In the gear chamber 21 are located the shaft ends 22, 23. The shaft end 22 of the drive shaft 15 extends out of the housing 11 and has there a connection 24 for a drive unit 49. On the drive shaft 15 is located a gearwheel 25. On the driven shaft is arranged a gearwheel 26. The teeth of the gearwheels 25, 26 are in meshing engagement.

On the driven shaft 16, a fastening element 27 is disposed on the shaft end 23. The fastening element 27 has a bushing portion 28 and a flange portion 29. The outer side of the bushing portion 28 is simultaneously the receiving surface 30 for the gearwheel 26. Into a groove (not represented) in the shaft end 23 and in the fastening element 27 is inserted a feather key 31, via which a rotationally operative connection between the shaft 16 and the fastening element 27 is established. In a bore (not represented) in the end face 32 of the shaft end 23 is screwed a hexagon bolt 33, with which a clamping washer 34 is screwed against a seat 35 on the fastening element 27. The fastening element 27 is thereby lockingly connected to the shaft end 23. The flange portion 29 has a bore 36. The gearwheel 26 has a corresponding bore 37, which can be realized as a throughbore or as a drilled hole. In the bore 37 is arranged a thread (not represented). A hexagon bolt 38 is screwed into this thread, whereby the flange portion 29 of the fastening element 27 is locked in place with the gearwheel 26. Behind the bushing portion 28 of the fastening element 27 is located a spacer bushing 39, which serves to ensure that the gearwheel 26 cannot make contact with the bearing portion 13 with the fastening screws 40 of the gear portion 14.

In FIG. 2, a sectional view through the gear portion 14 is represented. The mutually engaged gearwheels 25, 26 are apparent here. On the gearwheel 26, the fastening element 27 with its flange portion 29 is represented. Via the hexagon bolt 33, the clamping washer 34 is mounted in the seat 35 of the flange portion 29. The bore 36 in the flange portion 29 is here realized as an elongated hole 41. In addition, the gear portion 14 has on its top side an opening 42, which is retentively connected with a cap 43, via hexagon bolts 44, to the gear portion 14.

FIG. 3 shows a sectional view through the mutually engaged feed screws 17, 18. The feed screws have screw projections 45, which respectively have flanks 46. The distance between the flanks 46 constitutes the flank clearance 47. Through rotation of the driven shaft 16 and thus of the feed screw 18, whilst the drive shaft 15 and thus the feed screw 17 remain stationary, the flank clearance 47 changes in such a way that it becomes larger on one side and becomes smaller on the other side of the screw projection 45. The feed screws 17, 18 are optimally arranged such that the flank clearances to both sides of the screw projections 45 are equally large.

The adjustment of the flank clearance 47 is therefore made such that the fastening element 27 is arranged in a rotationally secure manner on the shaft end 23 or the driven shaft 16 by means of the feather key 31. After this, the clamping washer 34 is screwed into the seat via the hexagon bolt 33. At this point, the gearwheel 26 is already located on the receiving surface 30 of the bushing portion 28 of the fastening element 27 and is engaged with the gearwheel 25 of the drive shaft 15. For the adjustment of the flank clearance, the flange portion 29 with the elongated holes 41 located therein is now arranged via the bores in the gearwheel 26 and the hexagon bolts 38 are screwed in, whereupon still no locking connection between the flange portion 29 and the gearwheel 26 is formed. By rotating the flange portion 29, there is now the possibility of adjusting the flank clearance 47 between the feed screw 18 and the feed screw 17. Once the optimal adjustment of the flank clearance 47 is achieved, a locking connection is produced via the hexagon bolts 38.

FIG. 4 to FIG. 7 show an arrangement of the screw pump on a base plate 48. The screw pump 10 is here connected to a drive unit 49. FIG. 8 to FIG. 11 show a further embodiment, in which the pump is present in a block construction. In FIG. 7 and FIG. 11, top views of the gear portion 14 are respectively represented without mounted cap 43 on the opening 42. The gear portion 14 here has a plane portion 50, in which bores 51 are arranged around the opening 42, which bores have a thread (not represented) into which the hexagon bolts 44 can be screwed.

If it becomes necessary to reset the flank clearance 47 due to maintenance works, for example on the face seal, due to wear and tear, or due to a change of feed screws 17, 18, it is possible, by removing the hexagon bolts 44 and taking off the cap 43, to reach with a tool (not represented) through the opening 42 into the gear chamber 21. It is possible, for example, to release the hexagon bolts 38 in order to achieve a rotation of the driven shaft 16 relative to the gearwheel 26 and thus reset the flank clearance 47. Following adjustment of the flank clearance, the hexagon bolts 38 are then retightened and the cap 43 mounted with the hexagon bolts 44 back onto the plane portion 50 and made ready for service by insertion of the hexagon bolts 44 into the bore 51.

It is thus no longer necessary to detach the drive units 49 and/or the gear portion 14 of the housing 11. Furthermore, as a result of the elongated holes 41, it is no longer necessary to complexly remove the gearwheel 26 from the shaft 16 so as then to complexly adjust the flank clearance 47 by appropriately rotating the gearwheel 26 about a segment of a circle until the next bore 36 is aligned, and subsequently remounting the gearwheel 26 onto the shaft 16.

| Reference symbol list: | |
|---|---|
| 10 | screw pump |
| 11 | housing |
| 12 | pump portion |
| 13 | bearing portion |
| 14 | gear portion |
| 15 | driven shaft |
| 16 | driven shaft |
| 17 | feed screw |
| 18 | feed screw |
| 19 | needle bearing |
| 20 | roller bearing |
| 21 | gear chamber |
| 22 | shaft end |
| 23 | shaft end |
| 24 | connection |
| 25 | gearwheel |
| 26 | gearwheel |
| 27 | fastening element |
| 28 | bushing portion |
| 29 | flange portion |
| 30 | receiving surface |
| 31 | feather key |
| 32 | end face |

-continued

| Reference symbol list: | |
|---|---|
| 33 | hexagon bolt |
| 34 | clamping washer |
| 35 | seat |

The invention claimed is:

1. Two-spindle screw pump of single-flow construction, comprising a pump housing, which has a pump portion, a bearing portion and a gear portion with a gear chamber, wherein the bearing portion and the pump portion are realized separately from each other, comprising a feed housing part as a component part of the pump portion, in which two shaft-mounted feed screws with flanks are provided, wherein the shafts are mounted in the bearing portion (external bearing) and extend into the gear portion, comprising gearwheels, which are arranged on the shafts in the gear portion and by means of which the shafts are rotatably coupled, and comprising a fastening element, arranged on the shaft in operative connection therewith, for establishing a holding connection between shaft and gearwheel, wherein the fastening element and the gearwheel have corresponding bores, via which, between the gearwheel and the fastening element, a holding connection can be established via a locking element, characterized in that the gearwheels and shafts are held in place on one end by an endplate through which a drive shaft extends, and the bores in the fastening element are realized such that the gearwheel and the fastening element (and thus the shaft) are mutually rotatable, so that a spacing of the flanks of the feed screws (the flank clearance of the feed screws) is adjustable, in that an opening is provided on the gear portion of the pump housing, in that the opening is provided with a detachable cover, the opening and the cover distinct from the endplate and disposed to provide access with the detachable cover removed to the gear chamber, for the adjustment of the flank clearance of the feed screws, with a tool, with the pump in its mounted state with the drive shaft connected and the endplate in place; and further characterized in that the bores in the fastening element are here provided as a circumferential elongated hole, in which the locking element, in the inserted yet unlocked state, is circumferentially displaceable, and in that the circumferential length of the elongated hole is here provided such that its end points conform at least to points of contact of the flanks of the feed screws, and the circumferential length of the elongated holes is longer than the circumferential spacing of the points of contact of the flanks of the feed screws.

2. Screw pump according to claim 1, characterized in that the fastening element with the elongated holes is provided only on one shaft.

3. Pump according to claim 1, characterized in that a hydraulic separation exists between the pump portion and the bearing portion, or in that a spatial separation exists between the bearing portion and the gear portion.

4. Pump according to claim 3, characterized in that said hydraulic separation exists between the pump portion and the bearing portion via a face seal.

5. Pump according to claim 1, characterized in that the fastening element has a bushing portion for slipping onto the shaft, or wherein the shaft and the bushing portion have a groove for the reception of a feather key for establishing a rotationally operative connection between the shaft and the fastening element.

6. Pump according to claim 5, characterized in that said bushing portion has a receiving portion for the gearwheel.

7. Pump according to claim 1, characterized in that the bores of the gearwheel are realized as drilled holes with threaded portion, or in that a locking element in the form of a screw is insertable into the bores, via which screw the holding connection can be established.

8. Pump according to claim 1, characterized in that a bore is provided in the shaft head, into which bore can be introduced a locking element which locks the fastening element against the shaft.

* * * * *